US007137345B2

(12) United States Patent
Noble et al.

(10) Patent No.: US 7,137,345 B2
(45) Date of Patent: Nov. 21, 2006

(54) HIGH VOLUME LIQUID CONTAINMENT SYSTEM FOR SHIPS

(75) Inventors: Peter G. Noble, Spring, TX (US); Robert A. Levine, Houston, TX (US); Christopher T. Chipuk, College Station, TX (US); Edward G. Stokes, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 28 days.

(21) Appl. No.: 10/754,769

(22) Filed: Jan. 9, 2004

(65) Prior Publication Data

US 2005/0150443 A1 Jul. 14, 2005

(51) Int. Cl.
*B63B 25/08* (2006.01)

(52) U.S. Cl. ..... 114/74 R

(58) Field of Classification Search ..... 114/74 A, 114/74 R

See application file for complete search history.

(56) References Cited

U.S. PATENT DOCUMENTS

| | | | | |
|---|---|---|---|---|
| 3,332,386 | A | 7/1967 | Massac | |
| 3,562,977 | A | 2/1971 | Alleaume | |
| 3,724,411 | A | 4/1973 | Alleaume | |
| 3,814,275 | A | 6/1974 | Lemons | |
| 3,968,764 | A | 7/1976 | Kvamsdal et al. | |
| 4,095,546 | A * | 6/1978 | Kane | 114/74 R |
| 4,105,819 | A | 8/1978 | Kotcharian | |
| 4,199,909 | A | 4/1980 | Kotcharian | |
| 4,286,535 | A * | 9/1981 | Lunn | 114/74 R |
| 4,366,917 | A | 1/1983 | Kotcharian | |
| 4,378,403 | A | 3/1983 | Kotcharian | |
| 4,452,162 | A | 6/1984 | Harbaugh | |
| 4,498,304 | A | 2/1985 | Guilhem | |
| 4,513,550 | A | 4/1985 | Kotcharian | |
| 4,559,888 | A * | 12/1985 | Shudo et al. | 114/74 R |
| 5,727,492 | A | 3/1998 | Cuneo et al. | |
| 5,738,235 | A | 4/1998 | Johnsen | |
| 6,035,795 | A | 3/2000 | Dhellemmes et al. | |
| 6,637,359 | B1 * | 10/2003 | Hagner | 114/65 R |
| 6,675,731 | B1 * | 1/2004 | Dhellemmes | 114/74 A |
| 2002/0023926 | A1 * | 2/2002 | Dhellemmes | 220/586 |

FOREIGN PATENT DOCUMENTS

| | | |
|---|---|---|
| NO | WO9526482 | 10/1995 |

* cited by examiner

*Primary Examiner*—Ed Swinehart
(74) *Attorney, Agent, or Firm*—Hovey Williams LLP

(57) ABSTRACT

A liquid containment system for an ocean-going vessel. The liquid containment system includes a tank having converging upper walls. The converging upper walls of the tank contain a substantial portion of the liquid therebetween and reduce the free surface area associated with the liquid. The upper converging walls of the tank extend above the horizontal deck of the vessel, but still allow sufficient deck space for supporting various required equipment. In one embodiment, the liquid containment system is a prismatic membrane tank designed to receive and hold liquefied natural gas (LNG).

38 Claims, 3 Drawing Sheets

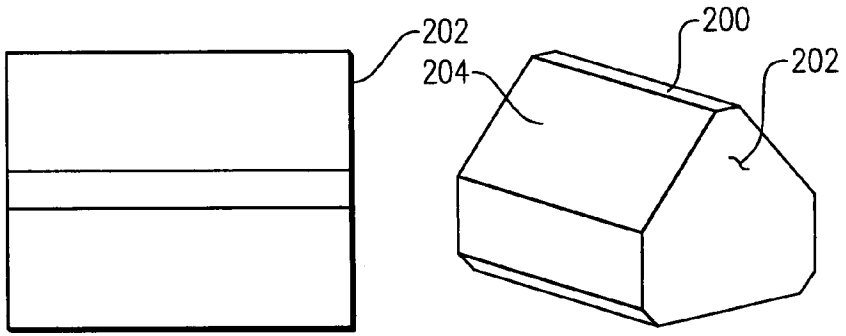
FIG. 6a
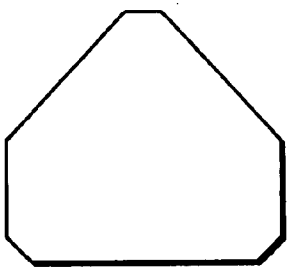
FIG. 6c
FIG. 6d
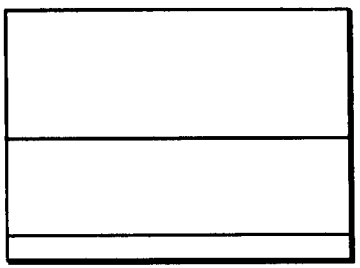
FIG. 6b
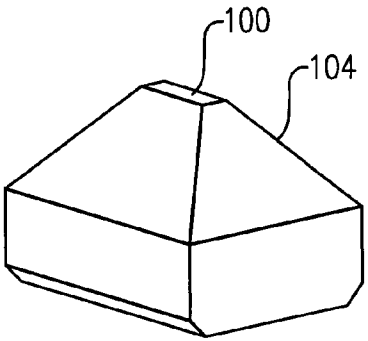
FIG. 5a
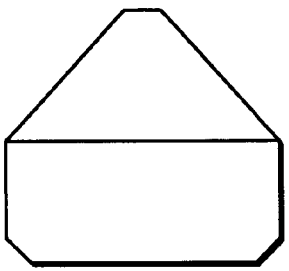
FIG. 5c
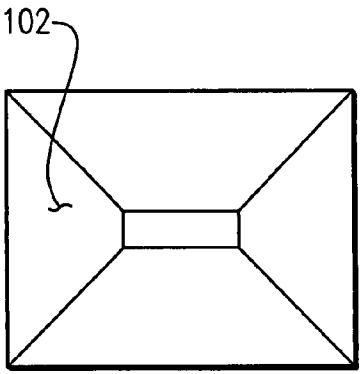
FIG. 5d
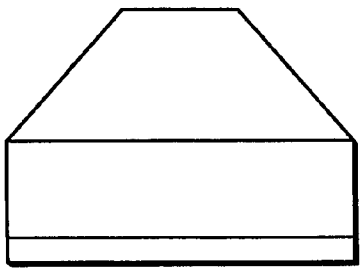
FIG. 5b

HIGH VOLUME LIQUID CONTAINMENT SYSTEM FOR SHIPS

BACKGROUND OF THE INVENTION

1. Field of the Invention

The present invention relates generally to marine transportation of liquids. In another aspect, the invention concerns ocean-going vessels for transporting liquefied natural gas (LNG) over large distances.

2. Description of the Prior Art

Vessels designed to carry liquefied natural gas (LNG) are among the most expensive commercial cargo-carrying vessels in the world. This is primarily due to the relatively light weight of LNG (requiring a large volume for a given weight of cargo) and the extremely low temperature required to keep the LNG in its liquid state under the low pressures necessary to enable long at-sea transit of commercially viable LNG quantities. LNG is typically transported at or slightly above atmospheric pressure and at a temperature of approximately −260° F. (−160° C.). All LNG containment systems (i.e., tanks) must be constructed of materials which can withstand the extremely low temperatures and the wide temperature changes from ambient conditions to in-service conditions. Further, all tanks must provide effective temperature insulation to prevent heat inflow and unacceptable cooling of the vessel's basic hull structure.

Conventional tanks for carrying LNG aboard ocean-going vessels generally fit into one of the following two categories: (1) "independent tanks," which are generally self-supporting and rely only upon foundations to transmit the gravitational and other forces of their weight and the weight of their contents to the surrounding hull structure; and (2) "membrane tanks," which rely entirely upon the surrounding hull structure to maintain their shape and integrity and to absorb all of the hydrostatic forces imposed by their contents. Membrane tanks are generally constructed of either stainless steel or Invar (a high nickel content alloy with minimal thermal expansion characteristics). Membrane tank systems include load-bearing thermal insulation that can transmit the hydrostatic and hydrodynamic loads to the hull structure.

A large percentage of LNG tanker-ships in use today include several independent, free-standing spherical tanks lined up along the length of the ship. Each spherical tank is supported by a cylinder or circular ring that is in turn supported by the bottom of the ship's hull. Spherical tanks, while attractive from the standpoint of maximizing volume-to-surface ratio and equalizing stresses over the surface, have serious drawbacks as cargo tanks. For example, the shape of a spherical tank does not match the shape of the tanker-ship, thereby resulting in wasted space in the hull. This void space near the bottom of the hull forces the center of gravity of the ship upwardly, thereby destabilizing the ship. Spherical tanks typically extend above the deck of the ship, which can dramatically reduce the amount of horizontal deck space available to supporting mooring equipment and other equipment. In addition, the spheres themselves are not free-standing, and so free-standing spherical tank systems include a significant support system. This support system adds both to the cost and the weight of the overall containment system.

Prismatic tanks avoid some drawbacks of spherical tanks. A "prismatic" tank is a tank that is shaped to follow the contours of the ship's hull. At midship the tanks may be in the shape of rectangular solids, with six flat sides (four vertical sides, a top side, and a bottom side). They may also have flat sides that converge downwardly to better match the hull. Free-standing prismatic tanks make more efficient use of below-deck volume than do spherical tanks. However, prismatic tanks contribute significantly to weight and cost because they employ heavy plates and a considerable amount of bracing to keep the plates from distorting under load. Some conventional LNG tanker-ships employ prismatic membrane tanks. Prismatic membrane tanks offer the same space efficiency advantages as independent prismatic tanks, but are typically much lighter than free-standing tanks.

When LNG is carried in a tanker-ship, sloshing of the LNG can be problematic because it increases the hydrodynamic loads on the tank, decreases the stability of the ship, and promotes vaporization of the LNG. Sloshing is cause by the movement of the ship and the existence of free surface area of the LNG. Sloshing could be substantially eliminated if it were possible to completely fill the tank with LNG. However, conventional practice is to fill LNG tanks to a maximum of about 98.5% of their full capacity so as to allow for expansion. In addition, it is not economically feasible to fill LNG tanks to 100% capacity because doing so would require a significant decrease in the fill rate of the tank during filling of the final 1–2% of capacity. This decrease in flow rate is required in order to avoid rapid over pressurization of the tank and/or overfilling and leakage through the venting or other systems. The filling of conventional LNG tanks to less than 100% capacity leaves a void space between the surface of the LNG and the top of the tank The resulting free surface area of the LNG allows sloshing to occur and promotes vaporization of the LNG. One way to inhibit sloshing in LNG tanks is to equip the tank with internal baffles. However, the use of anti-sloshing baffles increases the material, construction, and maintenance costs of the tank.

OBJECTS AND SUMMARY OF THE INVENTION

It is, therefore, an object of the present invention to provide a high volume liquid containment system for an ocean-going vessel that minimizes sloshing of the liquid without using internal baffles.

A further object of the present invention is to provide a high volume liquid containment system for an ocean-going vessel that enhances the stability of the vessel.

A still further object of the present invention is to provide a high volume liquid containment system for an ocean-going vessel that minimizes free surface area of liquid contained therein.

A yet further object of the present invention is to provide a high volume liquid containment system for an ocean-going vessel that makes efficient use of the volume defined within the hull.

Another object of the present invention is to provide a high volume liquid containment system for an ocean-going vessel that maintains the center of gravity of the vessel as low as possible.

Still another object of the present invention is to provide a high volume liquid containment system for an ocean-going vessel that is capable of being filled to various levels below its full capacity without causing unacceptable sloshing of the liquid during transportation.

Yet another object of the present invention is to provide a tanker-ship having a large amount of horizontal deck space to support mooring equipment and other equipment.

Yet still another object of the present invention is to provide a high volume LNG tank that minimizes vaporization of LNG during transportation.

It should be understood that these objects are only exemplary. Further objects and advantages of the present invention will be readily apparent upon reading the following detailed description and viewing the drawings.

It should be noted that certain systems which do not accomplish all of the above-listed objects may still fall within, and are intended to be encompassed by, the scope of the appended claims. The present invention includes various aspects that are capable of accomplishing one or more of the above listed objects.

A first aspect of the present invention provides a ship comprising a non-spherical tank defining a total internal volume. The tank includes at least three upwardly converging walls defining therebetween at least about 10 percent of the total internal volume.

A second aspect of the present invention provides a ship comprising a prismatic tank and a deck. The prismatic tank includes a pair of laterally spaced upwardly converging side walls. The deck presents a substantially horizontal upper surface when the ship is upright. At least a portion of the tank extends above the upper surface of the deck.

A third aspect of the present invention provides a tanker-ship for transporting a liquid. The ship comprises a tank defining an internal volume for receiving and holding the liquid. The internal volume has a shape which presents a pair of laterally spaced, upwardly converging side faces. Each of the side faces presents an upper edge and lower edge. The internal volume also presents a top face that extends between the upper edges of the converging side faces. The upper and lower edges of the converging side faces are vertically spaced from one another by a minimum vertical distance that is at least 20 percent of the maximum lateral distance between the lower edges of the converging side faces.

A fourth aspect of the present invention provides a tanker-ship for transporting LNG. The ship comprises a plurality of individual tanks and a structural deck. Each of the tanks defines a respective total internal volume for receiving and holding a quantity of the LNG. Each of the tanks includes at least three converging walls defining therebetween an upper portion of the internal volume. The upper portion of the internal volume presents at least three substantially planar faces defined by the converging side walls. The upper portion of the total internal volume has a volume that is in the range of from about 20 to about 40 percent of the total internal volume. At least a portion of the total internal volume extends above a substantially horizontal upper surface of the deck.

BRIEF DESCRIPTION OF THE DRAWING FIGURES

A preferred embodiment of the present invention is described in detail below with reference to the attached drawing figures, wherein.

Figure 1:
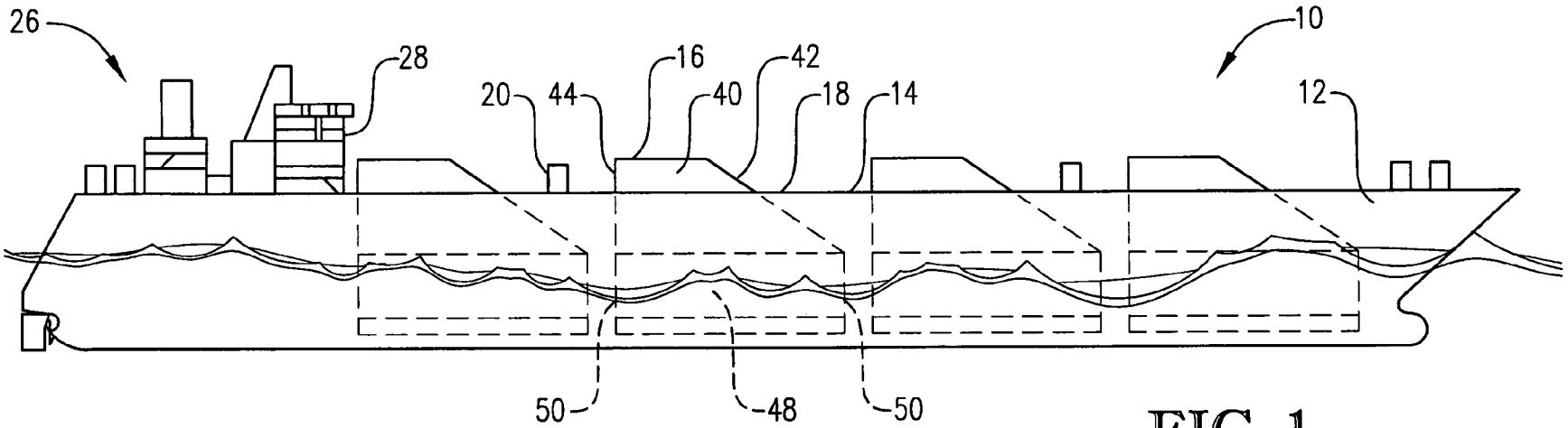
FIG. 1 is a side view of a tanker-ship constructed in accordance with the principles of the present invention, particularly illustrating the shape and orientation of a plurality of prismatic tanks received in and supported by the hull of the ship.
Figure 2:
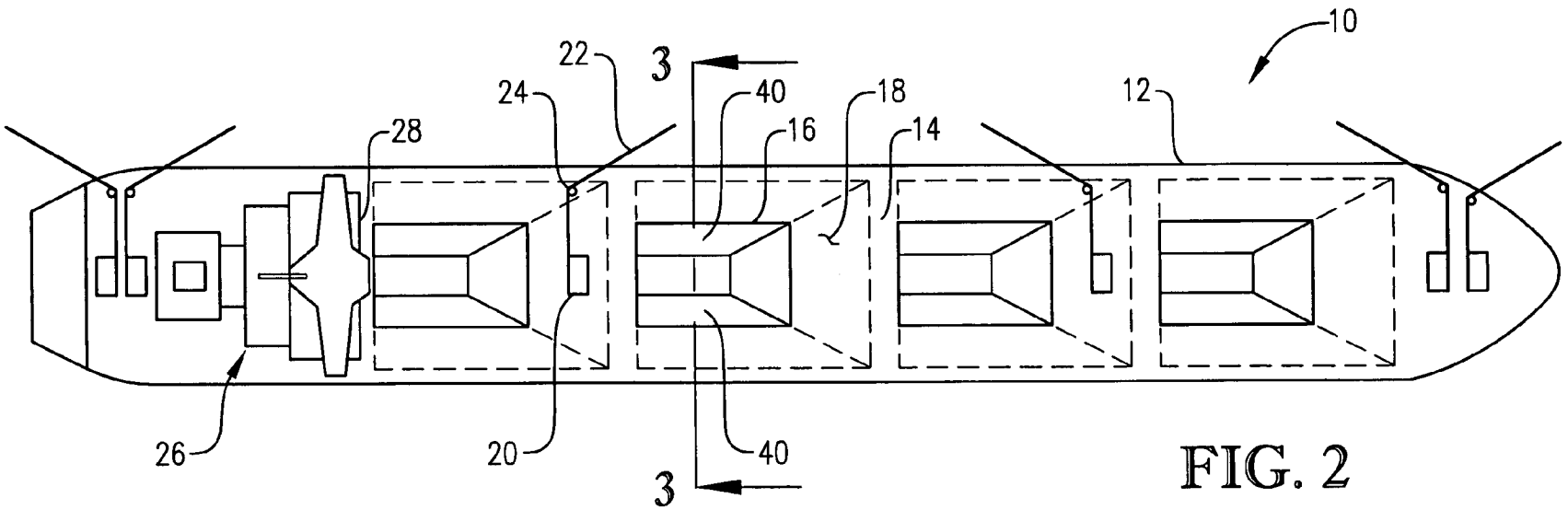
FIG. 2 is a top view of the tanker-ship shown in FIG. 1, particularly illustrating the arrangement of the mooring equipment supported on the deck of the ship.
Figure 4A:
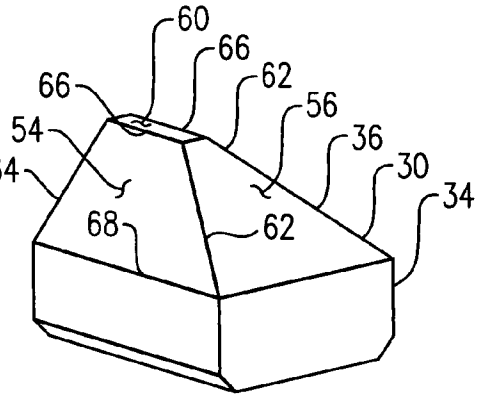
Figure 4C:
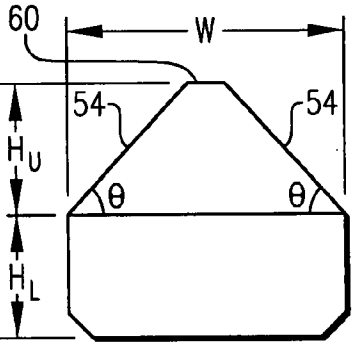
Figure 4D:
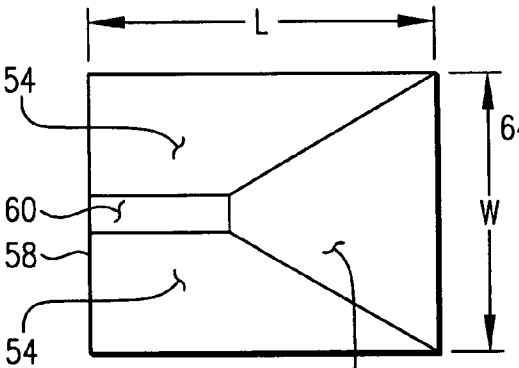
Figure 4B:
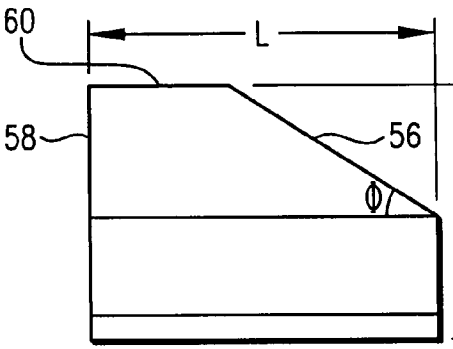
Figure 3:
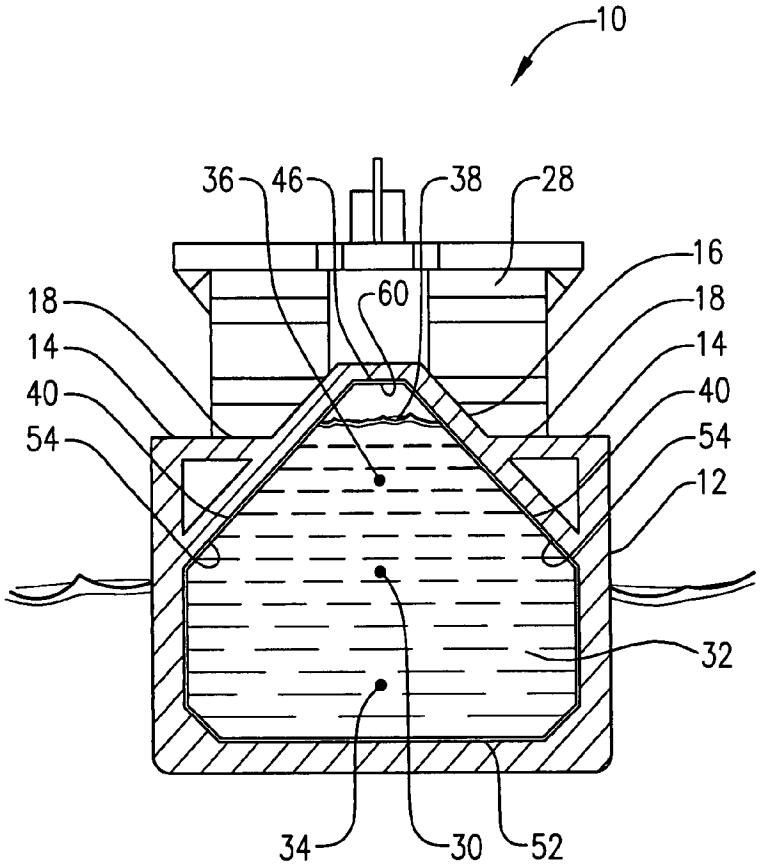
FIG. 3 is a sectional view of the tanker-ship taken along line 3—3 in FIG. 2, particularly illustrating the upwardly converging side walls of the tank, the liquid disposed within the internal volume defined by the tank, and the extension of the internal volume above the upper surface of the deck.

FIG. 4*a* is an isometric view illustrating the shape of the internal volume defined by the tanks of FIGS. 1–3, particularly illustrating a broad lower portion of the internal volume and an upwardly narrowing upper portion of the internal volume, with the upper portion presenting two converging side faces and a sloped front face;

FIG. 4*b* is a side view of the internal volume shown FIG. 4*a*, particularly illustrating the slope of the front face, the vertical orientation of the rear face, and the length of the internal volume;

FIG. 4*c* is an end view of the internal volume shown in FIG. 4*a*, particularly illustrating the slope of the side faces, the width of the internal volume, and the relative heights of the upper and lower portions of the internal volume;

FIG. 4*d* is a top view of the internal volume shown in FIG. 4*a*, particularly illustrating the length and width of the internal volume;

FIG. 5*a* is an isometric view of an alternative internal volume that can be defined by a tank having an alternative configuration, particularly illustrating that the upper portion of the internal volume has four upwardly converging faces, as opposed to the three upwardly converging faces of the internal volume illustrated in FIGS. 4*a–d;*

FIG. 5*b* is a side view of the internal volume shown in FIG. 5*a;*

FIG. 5*c* is a end view of the internal volume shown in FIG. 5*a;*

FIG. 5*d* is a top view of the internal volume shown in FIG. 5*a;*

FIG. 6*a* is an isometric view of an alternative internal volume that can be defined by a tank having an alternative configuration, particularly illustrating that the upper portion of the internal volume has only two upwardly converging faces, as opposed to the three upwardly converging faces of the internal volume illustrated in FIGS. 4*a–d;*

FIG. 6*b* is a side view of the internal volume shown in FIG. 6*a;*

FIG. 6*c* is a end view of the internal volume shown in FIG. 6*a*; and

FIG. 6*d* is a top view of the internal volume shown in FIG. 6*a.*

DETAILED DESCRIPTION OF THE PREFERRED EMBODIMENT

Referring initially to FIGS. 1 and 2, a tanker-ship 10 is illustrated as generally comprising a hull 12, a structural deck 14, and a plurality of tanks 16. Tanker-ship 10 can be any type of ocean-going vessel designed to carry a load of liquid over large distances. Preferably, tanker-ship 10 is a liquefied natural gas carrier (LNGC) that is equipped to transport liquefied natural gas (LNG) at low temperatures (e.g., about −260° F.) and at approximately atmospheric pressure. Tanks 16 are received in and supported by hull 12. Deck 14 extends across the top of hull 12 and presents a substantially planar, substantially horizontal, exposed upper surface 18. It is preferred for a portion of tanks 16 to extend above upper deck surface 18.

Tanker-ship 10 can also include mooring equipment supported on upper surface 18 of deck 14. The mooring equipment generally includes a mooring winch 20, a mooring line 22, and a bit 24. It is preferred for mooring winch 20 to be spaced from the sides of tanker-ship 10 in order to provide a greater length of the mooring line 22. A longer mooring line provides for safer mooring of tanker-ship 10 because mooring line 22 is resilient and allows for some movement between tanker-ship 10 and the dock (not shown). Short mooring lines create a more rigid connection between the dock and tanker-ship 10. Such a rigid connection can damage tanker-ship 10 and/or the dock if an outside force (e.g., wind and waves) urges relative movement between tanker-ship 10 and the dock. Thus, it is preferred for mooring winch 20 to be located at about the longitudinal center line of ship 10, with bit 24 being located proximate the side of ship 10. Preferably, at least one mooring winch 20 is located on the substantially horizontal upper surface 18 of deck 14 between the portions of adjacent tanks 16 that extend above upper deck surface 18. In addition, a rear super structure 26 extends upwardly from deck 14 behind tanks 16. Rear super structure 26 includes an aft bridge 28, which should be sufficiently elevated above upper deck surface 18 so as to provide visibility over the portions of tanks 16 that extend above upper deck surface 18.

Referring now to FIG. 3, tank 16 defines an internal volume 30 for receiving and holding a liquid 32. As illustrated in FIG. 3, tank 16 is a prismatic tank that conforms generally to the shape of hull 12. It is preferred for tank 16 to be a prismatic membrane tank configured to receive and hold LNG. Prismatic membrane tanks are well-known in the art and generally include a liquid-impermeable membrane (e.g., stainless steel or Invar) defining the internal volume of the tank and a load-bearing insulation system that transfers the hydrostatic and hydrodynamic forces of the liquid to the hull. While the present invention is particularly well-suited for LNG tanker-ships employing prismatic membrane tanks, it should be understood that the invention also provides advantages when used in non-LNG transportation and/or when used with independent (i.e., free-standing) tanks.

As shown in FIG. 3, which is a cross-sectional view taken orthogonally to the direction of elongation of tanker-ship 10, upper deck surface 18 extends outwardly on opposite sides of tank 16. The cross-section of FIG. 3 is taken at a location which shows the minimum width of upper deck surface 18 along the longitudinal axis of tanker-ship 10 where tanks 16 are present. It is preferred for the cumulative width of upper deck surface 18 (i.e., the combined width of upper deck surface 18 on both sides of tank 16) to be at least about 25 percent as wide as the total width of the ship at all locations where a cross-section that is orthogonal to the direction of elongation of tanker-ship 10 and that extends through tanks 16 can be taken, more preferably the cumulative width of upper deck surface 18 is in the range of from about 35 to about 75 percent of the maximum width of the ship at such locations. This minimum width of upper deck surface 18 ensures that enough horizontal space will be provided for supporting various equipment (e.g., reliquefaction equipment and/or mooring equipment). As shown in FIG. 2, it is preferred for upper surface 18 of deck 14 to circumscribe tanks 16 at the locations where tanks 16 protrude upwardly from upper surface 18 .

Referring again to FIG. 3, internal volume 30 defined by tank 16 generally includes a relatively broad lower portion 34 and an upwardly narrowing upper portion 36. The fact that upper portion 36 of internal volume 30 is narrower at the top than at the bottom reduces the free surface area 38 of liquid 32. This reduction in free surface area 38, reduces sloshing of liquid 32 within tank 16. The reduction of sloshing can provide a more stable vessel without requiring internal baffles. In addition, when liquid 32 is LNG, the reduction in free surface area 38 and the reduction in sloshing can help to minimize vaporization of the LNG. Further, when tank 16 is a membrane tank, the reduction of the sloshing can help to prevent damage to the membrane.

Referring to FIGS. 1–3, upper portion 36 of internal volume 30 is defined between a pair of laterally spaced, upwardly converging side walls 40, a front wall 42, and a rear wall 44 of tank 16. When used to describe the configuration of tanker-ship 10, the term "laterally" shall denote a direction that is perpendicular to the axis of elongation of the ship 10. A cap 46 of tank 16 is coupled to and extends laterally across the uppermost edges of side walls 40 to thereby define the top of internal volume 30. Lower portion 34 of internal volume 30 has a fairly conventional configuration being defined by a pair of vertical or slightly downwardly converging side walls 48, a pair of vertical end walls 50, and extending base 52.

Some conventional prismatic tanks included short, upwardly converging side walls at the top of the vertical sidewalls. However, the upwardly converging side walls of these conventional prismatic tanks do not extend nearly as far upward as side walls 40 of the inventive tank 16. Therefore, such conventional tanks do not adequately minimize free surface area and do not allow a significant portion of the liquid to be contained between the converging side walls. With respect to inventive tank 16, it is preferred for the volume of upper portion 36 to be at least about 10 percent of the total volume of internal volume 30, more preferably at least about 15 percent of the total volume, still more preferably in the range of from about 20 to about 40 percent of the total volume, and most preferably in the range of from 25 to 35 percent of the total volume. It is also preferred for the volume of lower portion 34 to be in the range of from about 60 to about 90 percent of the total volume of internal volume 30, most preferably in the range of from 75 to 85 percent of the total volume.

Referring now to FIGS. 1–3 and 4*a–c*, upper portion 36 of internal volume 30 presents a pair of upwardly converging side faces 54 that are defined by the inner surface of side walls 40. Upper portion 36 also presents a front and rear faces 56,58 that are defined by the inner surfaces of front and rear walls 42, 44 respectively. In addition, upper portion 36 presents a top face 60 that is defined by the inner surface of cap 46. In the description that follow, the shape of internal volume 30 is defined in detail. It should be understood that a description of the shape of internal volume 30 inherently describes the shape of tank 16 because each face of internal volume 30 is defined by an inner surface of tank 16.

Referring to FIGS. 4*a–d*, it is preferred for the side, front, rear, and top faces 54, 56, 58, 60 to be substantially planar. Each of the side faces 54 presents a front edge 62, a rear edge 64, a top edge 66, and a bottom edge 68. Front face 56 extends between front edges 62, rear face 58 extends between rear edges 64, and top face 60 extends between top edges 66. It should be understood that edges 62, 64, 66, 68 can be somewhat rounded. It is preferred for top edges 66 to extend substantially parallel to one another and for bottom edges 68 to extend substantially parallel to one another. However, when internal volume 30 is defined within a tank that is located near the front or rear of the ship, top edges 66 and bottom edges may need to be skewed to conform to the shape of the hull. Referring to FIG. 4*c*, it is preferred for side faces 54 to extend upwardly at an angle (Θ) that is at least about 20 degrees from horizontal, more preferably at an angle (Θ) in the range of from about 30 to about 60 degrees, and most preferably at an angle (Θ) in the range of 40 to 50 degrees. Referring to FIG. 4*b*, it is preferred for front face 56 to extend upwardly at an angle (Φ) that is at least about 10 degrees from horizontal, more preferably at an angle (Φ) in the range of from about 15 to about 60 degrees, and most preferably at an angle (Φ) in the range of 20 to 45 degrees. It is preferred for rear face 58 to extend substantially vertically and for top face 60 to extend substantially horizontally.

As shown in FIGS. 4*a–d*, internal volume 30 has a width (W), a length (L), a total height ($H_T$), a height of the upper portion ($H_U$), and a height of the lower portion ($H_L$). It is preferred for internal volume 30 to have a length (L) that is greater than its width (W), most preferably the ratio of length (L) to width (W) is in the range of 1.25:1 to 2:1. It is preferred for internal volume 30 to have a ratio of total height ($H_T$) to width (W) that is in the range of from about 0.5:1 to about 2:1, most preferably in the range of 0.75:1 to 1.5:1. It is preferred for the height of the upper portion ($H_U$) to be at least about 25 percent of the total height ($H_T$) of internal volume 30, more preferably at least about 35 percent of the total height ($H_T$), still more preferably in the range of from about 40 to about 75 percent of the total height ($H_T$), and most preferably in the range of 50 to 60 percent of the total height ($H_T$). It is preferred for the height of the lower portion ($H_L$) to be in the range of from about 25 to about 75 percent of the total height ($H_T$), most preferably in the range of 40 to 60 percent of the total height ($H_T$). It is preferred for the height of the upper portion ($H_U$) to be at least about 20 percent of the maximum width (W) of internal volume 30, more preferably the height of upper portion ($H_U$) is in the range of from about 30 to about 70 percent of the maximum width (W) of internal volume 30, and most preferably in the range of 40 to 60 percent of the maximum width (W).

Referring to FIGS. 3 and 4*a–d*, it is preferred that side walls 40 do not converge into contact with one another to thereby form a point. Thus, it is preferred for side walls 40 to be spaced by a minimum distance (i.e., the width of top face 60) that is at least about 5 percent of the maximum width (W) of internal volume 30, more preferably in the range of from about 5 to about 50 percent of the maximum width (W), and most preferably in the range of 10 to 25 percent of the maximum width (W). Converging side walls 40, as well as front wall 42 causes the free surface area 38 of liquid 32 to be substantially less at the top of upper portion 36 than at the bottom of upper portion 36. The free surface area at various vertical locations in the internal volume 30 can be defined by the area of a horizontal plane extending though internal volume 30 and bounded by the outer faces of internal volume 30. It is preferred for the free surface area at the vertical location of upper edges 66 to be less than about 75 percent of the free surface area at the vertical location of bottom edges 68, more preferably less than about 50 percent of the free surface area at bottom edges 68, and most preferably less than 25 percent of the free surface area at bottom edges 68.

Referring to FIG. 3, upper deck surface 18 preferably defines a substantially horizontal plane that intersects side walls 40 of tank 16. It is preferred for at least about 2 percent of internal volume 30 to be disposed at a vertical elevation above upper deck surface 18, most preferably 5 to 20 percent of internal volume 30 is disposed above the vertical elevation of upper deck surface 18.

Referring now to FIGS. 5*a–d*, an alternatively configured internal volume 100 is illustrated. Internal volume 100 has a similar shape to internal volume 30, described above with reference to FIGS. 4*a–d*, except that internal volume 100 includes a rear face 102 that is sloped rather than vertical. It is preferred for rear face 102 to have substantially the same slop as front face 56 of internal volume 30, described above. Thus, upper portion 104 of internal volume 100 presents four upwardly converging faces.

Referring now to FIGS. 6*a–d*, an alternatively configured internal volume 200 is illustrated. Internal volume 200 has a similar shape to internal volume 30, described above with reference to FIGS. 4*a–d*, except that internal volume 200 includes a front face 202 that is substantially vertical. Thus, upper portion 204 of internal volume 200 presents only two upwardly converging faces (i.e., the side faces).

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A ship comprising:

a non-spherical tank defining a total internal volume; and a deck presenting a substantially flat, substantially horizontal upper surface, said tank including at least three upwardly converging walls defining therebetween at least about 10 percent of the total internal volume, said upper surface of the deck defining a substantially horizontal plane that intersects the converging walls of the tank above the lower edges of the converging walls, said converging walls including a pair of opposing, laterally spaced, converging side walls, each of said side walls extending upwardly at an angle in the range of from about 30 degrees to about 60 degrees from horizontal.

2. The ship according to claim 1, said converging walls defining therebetween an upper portion of the total internal volume, said upper portion having a volume that is at least 15 percent of the total internal volume.

3. The ship according to claim 2, said upper portion having a volume that is in the range of from about 20 percent to about 40 percent of the total internal volume.

4. The ship according to claim 1, each of said converging walls presenting a substantially planar inner surface defining a portion of the internal volume.

5. The ship according to claim 1, each of said side walls presenting front and rear edges, said converging walls including a front wall extending between the front edges of the side wall, said front wall extending upwardly at a angle that is at least about 10 degrees from horizontal.

6. The ship according to claim 5, said front wall extending upwardly at a angle in the range of from about 15 degrees to 60 degrees from horizontal.

7. The ship according to claim 5, said tank including a rear wall extending between the rear edges of the side walls, said rear wall extending upwardly at an angle that is at least about 10 degrees from horizontal.

8. The ship according to claim 7, said rear wall extending upwardly at an angle in the range of from about 15 degrees to about 60 degrees from horizontal.

9. The ship according to claim 1, at least 2 percent of said total internal volume being located above the elevation of the upper surface.

10. The ship according to claim 1, said upper surface extending outwardly from two opposite sides of the tank.

11. The ship according to claim 1, said upper surface circumscribing the tank.

12. The ship according to claim 1, said ship comprising at least two of said tanks, said upper surface extending between the tanks.

13. The ship according to claim 12; and a mooring winch supported on the upper surface of the deck between the tanks.

14. The ship according to claim 1, said upper surface having a cumulative width that is at least 25 percent of the maximum width of the ship at all locations where a cross-section that is orthogonal to the direction of elongation of the ship and extends through the tank can be taken.

15. The ship according to claim 1, said tank being a prismatic membrane tank.

16. The ship according to claim 1, said ship including at least three of said tanks.

17. A ship comprising:

a non-spherical tank defining a total internal volume, said tank including at least three upwardly converging walls defining therebetween at least about 10 percent of the total internal volume, said converging walls including a pair of opposing, laterally spaced, converging side walls, each of said side walls extending upwardly at an angle that is at least about 20 degrees from horizontal, each of said side walls presenting front and rear edges, said converging walls including a front wall extending between the front edges of the side walls, said front wall extending upwardly at an angle that is at least about 10 degrees from horizontal, said tank including a rear wall extending between the rear edges of the side walls, said rear wall extending upwardly at an angle that is at least about 10 degrees from horizontal, said rear wall extending substantially vertically.

18. A tanker-ship for transporting a liquid, said ship comprising:

a tank defining therein an internal volume for receiving and holding the liquid; and a deck presenting a substantially flat, substantially horizontal upper surface, said internal volume presenting a pair of laterally spaced, upwardly converging side faces, each of said side faces presenting an upper edge and a lower edge, said internal volume including a top face extending between the upper edges, said upper and lower edges being vertically spaced from one another by a minimum vertical distance that is at least 20 percent of the maximum lateral distance between the lower edges, said internal volume including a third face converging upwardly with the side faces said upper surface of the deck defining a substantially horizontal plane that intersects the side faces of the tank above the lower edges of the side faces.

19. A ship according to claim 18, said upper and lower edges being vertically spaced from one another by a minimum vertical distance in the range of from about 30 to about 70 percent of the maximum lateral distance between the lower edges.

20. A ship according to claim 18, said upper edges being substantially coplanar, said lower edges being substantially coplanar.

21. A ship according to claim 18, said upper edges extending substantially parallel to one another, said lower edges extending substantially parallel to one another.

22. A ship according to claim 18, said top and side faces being substantially flat.

23. A ship according to claim 18, said top face being substantially horizontal.

24. A ship according to claim 18, each of said side faces extending upwardly at an angle that is in the range of from about 30 degrees to about 60 degrees from horizontal.

25. A ship according to claim 18, each of said side faces extending upwardly at a 40 degrees to 50 degrees angle from horizontal.

26. A ship according to claim 18, said side faces being closest to one another at the upper edges and farthest from one another at the lower edges.

27. A ship according to claim 18, said upper edges being laterally spaced from one another by a minimum lateral distance that is at least about 5 percent of the maximum lateral distance between the lower edges.

28. A ship according to claim 18, said upper edges being laterally spaced from one another by a minimum lateral distance that is 10 to 25 percent of the maximum lateral distance between the lower edges.

29. A ship according to claim 18, said tank including a pair of converging side walls defining the pair of side faces, said pair of side walls defining therebetween an upper portion of the internal volume, said upper portion having a volume that is at least 15 percent of the total volume of the internal volume.

30. A ship according to claim 29, said upper portion having a volume that is in the range of from about 20 to about 40 percent of the total volume of the internal volume.

31. A ship according to claim 29, said tank including a cap cooperating with the side walls to define the upper portion, said cap extending between the side walls and defining the top face.

32. A ship according to claim 18, said liquid comprising LNG.

33. A tanker-ship for transporting LNG, said ship comprising:

a plurality of individual tanks; and a structural deck presenting an exposed, substantially horizontal upper surface, each of said tanks defining therein a respective total internal volume for receiving and holding a quantity of the LNG, each of said tanks including at least three converging walls defining therebetween an upper portion of the total internal volume, said upper portion presenting at least three substantially flat faces defined by the converging side walls, said upper portion of the total internal volume having a volume that is in the range of from about 20 to about 40 percent of the total internal volume, at least a portion of said upper portion of the total internal volume extending above the deck, said upper surface of the deck defining a substantially horizontal plane that intersects the converging walls of the tank above the lower edges of the converging walls.

34. The ship according to claim 33, said substantially flat faces including a pair of laterally spaced side faces, each of said side faces extending upwardly at an angle in the range of from about 30 degrees to about 60 degrees from horizontal.

35. The ship according to claim 34, said substantially flat faces including a front face extending between the side faces, said front face extending upwardly at an angle in the range of from about 15 degrees to about 60 degrees from horizontal.

36. The ship according to claim 35, said upper portion of the total internal volume including a substantially vertical rear face extending between the side faces.

37. The ship according to claim 33, said upper portion of the total internal volume having a volume that is 25 to 35 percent of the total internal volume.

38. The ship according to claim 33, each of said tanks being a prismatic membrane tank.

* * * * *